US006263730B1

(12) United States Patent
Grande et al.

(10) Patent No.: US 6,263,730 B1
(45) Date of Patent: Jul. 24, 2001

(54) DOWNHOLE PUMP STRAINER DATA RECORDING DEVICE AND METHOD

(76) Inventors: Rene Grande, 88 Selkirk Boulevard, Red Deer, Alberta (CA), T4N 0G7; Fred Zillinger, P.O. Box 9042, Sylvan Lake, Alberta (CA), T4S 1S6; Terry McColl, 41 Atlee Close, Red Deer, Alberta (CA), T4R 2L9

( * ) Notice: Subject to any disclaimer, the term of this patent is extended or adjusted under 35 U.S.C. 154(b) by 0 days.

(21) Appl. No.: 09/549,674

(22) Filed: Apr. 14, 2000

(30) Foreign Application Priority Data

Apr. 16, 1999 (CA) ..... 2269300

(51) Int. Cl.[7] ..... E21B 47/06; E21B 43/00; E21B 23/08; G01V 1/00

(52) U.S. Cl. ..... 73/152.28; 73/152.02; 73/152.53; 73/152.55; 166/254.2; 166/264

(58) Field of Search ..... 73/152.02, 152.05, 73/152.28, 152.53, 152.55, 152.29, 152.61; 166/254.2, 250.15, 250.07, 264, 250.11

(56) References Cited

U.S. PATENT DOCUMENTS

| | | | | |
|---|---|---|---|---|
| Re. 31,222 | | 4/1983 | McCracken | 364/571 |
| 2,964,941 | * | 12/1960 | Marsh et al. | 73/155 |
| 3,028,542 | * | 4/1962 | Terry | 324/10 |
| 3,369,395 | * | 2/1968 | Scott et al. | 73/152 |
| 3,373,604 | * | 3/1968 | Dudman | 73/152 |
| 4,006,630 | * | 2/1977 | Cathriner | 73/155 |
| 4,033,186 | | 7/1977 | Bresie | 73/154 |
| 4,161,782 | | 7/1979 | McCracken | 364/571 |
| 4,593,370 | | 6/1986 | Balkanli | 364/571 |
| 4,661,751 | * | 4/1987 | Werner | 318/332 |
| 4,665,398 | | 5/1987 | Lynch et al. | 340/853 |
| 4,709,234 | | 11/1987 | Forehand et al. | 340/856 |
| 4,715,002 | | 12/1987 | Vernon et al. | 364/422 |
| 4,866,607 | | 9/1989 | Anderson et al. | 364/422 |
| 4,977,958 | | 12/1990 | Miller | 166/205 |
| 5,006,044 | * | 4/1991 | Walker, Sr. et al. | 417/12 |
| 5,153,832 | | 10/1992 | Anderson et al. | 364/422 |
| 5,186,048 | * | 2/1993 | Foster et al. | 73/155 |
| 5,337,234 | | 8/1994 | Anderson et al. | 364/422 |
| 5,784,004 | * | 7/1998 | Esfahani et al. | 340/854.6 |
| 5,823,262 | * | 10/1998 | Dutton | 166/250.15 |
| 6,092,598 | * | 7/2000 | Breit | 166/250.01 |

* cited by examiner

*Primary Examiner*—Hezron Williams
*Assistant Examiner*—David J. Wiggins
(74) *Attorney, Agent, or Firm*—Rodman & Rodman

(57) ABSTRACT

A device for sensing and recording downhole data relating to an ambient environment in a production well and a method for obtaining such downhole data utilizing the device. Further, the device is used in combination with a downhole pump, and preferably, in combination with a strainer for the downhole pump. The device is connected with the downhole pump, and particularly the strainer, such that the device and the downhole pump may be conveyed or transported within, and retrieved from, the production well together or as an integral unit. The device is comprised of: a housing connected with the downhole pump such that the housing is conveyed with the downhole pump within the production well; a sensor unit contained within the housing and communicating with the ambient environment, wherein the sensor unit senses at least one condition of the ambient environment and produces output data indicative of each condition; a recording unit contained within the housing and communicating with the sensor unit, wherein the recording unit receives and stores the output data produced by the sensor unit to provide a data sample for each condition; and a power source contained within the housing for powering the device.

63 Claims, 3 Drawing Sheets

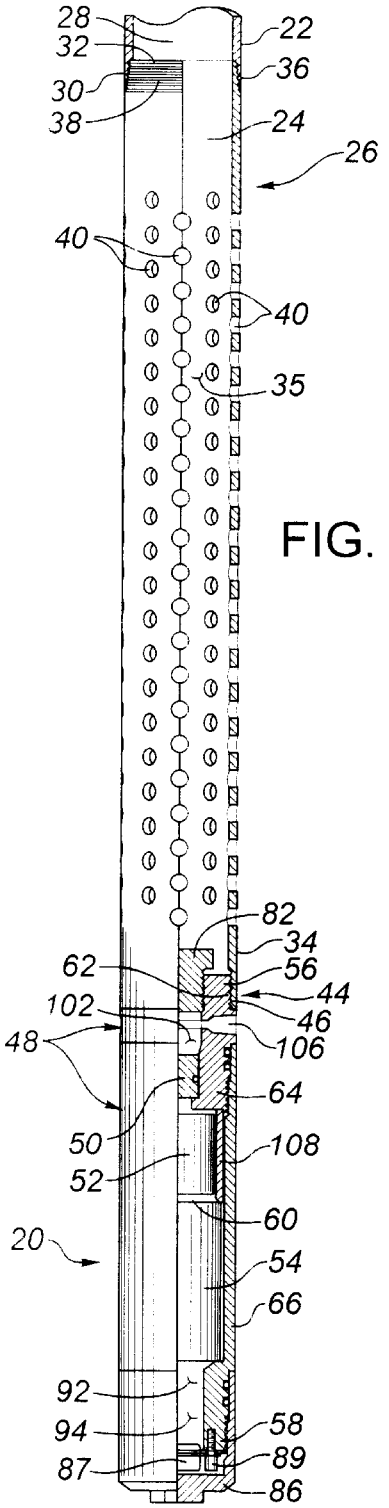
FIG. 1
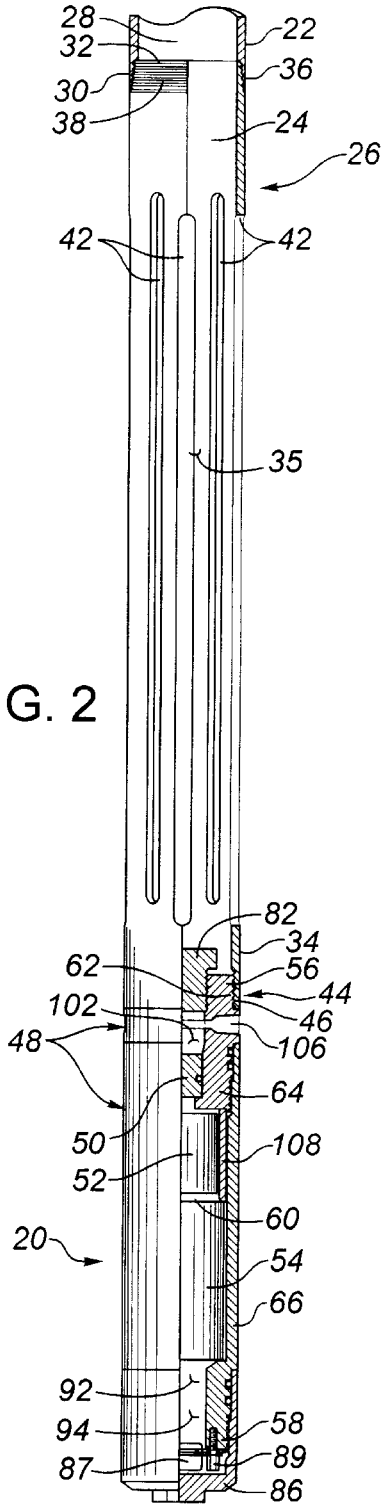
FIG. 2
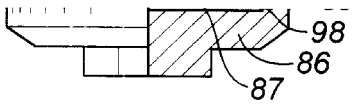

DOWNHOLE PUMP STRAINER DATA RECORDING DEVICE AND METHOD

FIELD OF INVENTION

The present invention relates to a device for sensing and recording downhole data elating to an ambient environment in a production well and a method for obtaining such downhole data utilizing the device. Further, the invention relates to utilizing the device in combination with a downhole pump, and preferably, in combination with a strainer for the downhole pump.

BACKGROUND OF INVENTION

Various downhole gauges and memory tools are known for obtaining data relating to the downhole conditions in a borehole. Previously, these gauges were largely mechanical or electromechanical tools used to measure such conditions as downhole pressure and temperature. More recently, these gauges have tended to be primarily electronic tools utilizing downhole microprocessors which either transmit the downhole data to the surface for analysis or store such downhole data in the tool for subsequent retrieval and analysis at the surface.

Various examples of self-contained downhole measurement systems or gauges, which store the data therein for subsequent retrieval and analysis at the surface, are provided by U.S. Pat. No. 4,033,186 issued Jul. 5, 1977 to Bresie, U.S. Pat. No. 4,161,782 issued Jul. 17, 1979 to McCracken and reissued on Apr. 26, 1983 as U.S. Pat. No. Re. 31,222, U.S. Pat. No. 4,593,370 issued Jun. 3, 1986 to Balkani, U.S. Pat. No. 4,665,398 issued May 12, 1987 to Lynch et. al., U.S. Pat. No. 4,709,234 issued Nov. 24, 1987 to Forehand et. al., U.S. Pat. No. 4,715,002 issued Dec. 22, 1987 to Vernon et. al., U.S. Pat. No. 4,866,607 issued Sep. 12, 1989 to Anderson et. al., U.S. Pat. No. 5,153,832 issued Oct. 6, 1992 to Anderson et. al. and U.S. Pat. No. 5,337,234 issued Aug. 9, 1994 to Anderson et. al.

More particularly, the apparatus of Bresie is specifically designed for use in sensing downhole conditions in an oil well drill hole, and more particularly, for measuring pressure and temperature conditions within the oil well drill hole, to assist in directing the drilling operation. The drilling operation ceases and the self-contained apparatus of Bresie is lowered into the drilling hole suspended from a line, such as a wire, cable or pipe, to the desired depth. Following the recording of the downhole data in the drilling hole, the apparatus is removed from the drilling hole and the downhole data is retrieved at the surface for analysis. The drilling operation is then resumed.

Similarly, Lynch et. al., Forehand et. al., and each Anderson et. al. relate to a method or self-contained downhole gauge disposed in a wellbore for sampling and recording information pertaining to a physical condition in the wellbore. The self-contained downhole gauge is described as being disposed in the wellbore by a suitable hoisting or tool carrier means of a type as known to the art. More particularly, by way of example, the suitable known hoisting or carrier means are described to be a wireline or a drill string which is raised and lowered in the wellbore by draw works and traveling block as known to the art.

Vernon et. al. also describes the use of a measuring sonde for recording a variable value or measurement in a producing petroleum well as a function of a parameter such as time. The measurement sonde is lowered into the producing well suspended at the end of a simple wireline or a cable which goes through the wellhead at the surface and runs over a return pulley and winds on a winch. This arrangement makes it possible to move the sonde in the well by reeling or unreeling the wireline or cable.

The above-described mechanism for transporting or conveying the measurement apparatus, gauge or sonde within the wellbore may be unsatisfactory for some applications or uses, such as for the measurement of downhole conditions in a production well. For instance, the use of a wireline or cable typically requires specialized equipment, such as a wireline truck, and specialized personnel trained in its use. The need for specialized equipment and personnel may increase the time and cost associated with placing the measurement apparatus, obtaining the measurements and subsequently removing the apparatus. Further, production from the wellbore may need to be terminated during the taking of the measurements by the apparatus.

Thus, there is a need in the industry for a device for sensing and recording downhole data relating to an ambient environment in a production well and a method for obtaining such downhole data utilizing the device. Further, there is a need for such a device which may be installed in and removed from the production well without the need for specialized equipment or personnel as described above.

SUMMARY OF INVENTION

The present invention relates to a device for sensing and recording downhole data relating to an ambient environment in a production well capable of producing fluids under a group of well operating conditions and to a method for obtaining downhole data relating to an ambient environment in a production well. Preferably, the method is performed utilizing the device. Further, the invention relates to a device for sensing and recording downhole data relating to an ambient environment in a production well in combination with a downhole pump, and preferably, in combination with a strainer for the downhole pump.

In a first aspect of the invention, the invention is comprised of a device for sensing and recording downhole data relating to an ambient environment in a production well in combination with a downhole pump. Preferably, the device is comprised of:

(a) a housing connected with the downhole pump such that the housing is conveyed with the downhole pump within the production well;

(b) a sensor unit contained within the housing and communicating with the ambient environment, wherein the sensor unit senses at least one condition of the ambient environment and produces output data indicative of each condition;

(c) a recording unit contained within the housing and communicating with the sensor unit, wherein the recording unit receives and stores the output data produced by the sensor unit to provide a data sample for each condition; and (d) a power source contained within the housing for powering the device.

The device may be used in combination with any type of downhole pump for a production well. Thus, for instance, the downhole pump may be a reciprocating rod pump or a rotary pump. Further, the device may be connected with the downhole pump, either directly or indirectly, in any manner and by any connecting, attaching, mounting or fastening mechanism, structure or method such that the device may be conveyed or transported within the production well with the downhole pump. Preferably, the device is connected with the downhole pump such that the device and the downhole pump may be conveyed or transported within the production well together or as an integral unit.

Further, the device, and any part or portion thereof, may be attached, fastened, mounted or otherwise connected with the any part or portion of the downhole pump. Preferably, the device is comprised of a housing which is connected with any part or portion of the downhole pump. As well, the downhole pump has an uphole end and a downhole end. Thus, the housing may be connected with either the uphole end or the downhole end of the downhole pump. However, preferably, the housing is connected with the downhole end of the pump.

The downhole end of the pump is preferably comprised of a pump intake and the housing is preferably connected with the pump intake. The pump intake may be comprised of any inlet or intake structure permitting the ambient environment in the production well to communicate with the downhole pump, and particularly, with the interior of the downhole pump. Thus, for instance, the pump intake may be comprised of any inlet or intake structure permitting the passage of fluids from the production well into the downhole pump.

In the preferred embodiment, the pump intake is comprised of a strainer. The strainer may be of any type, length or configuration. For instance, the strainer may be perforated, slotted, corrugated, filtered or flow through. Thus, in the preferred embodiment, the housing is connected with the strainer. The strainer preferably has an upper end and a lower end. The device, and preferably the housing, may be connected with either the upper end or the lower end of the strainer. More preferably, the housing is connected with the lower end of the strainer.

Thus, in the preferred embodiment, the pump intake is comprised of a strainer having a lower end. Further, the device is comprised of a housing having an upper end and a lower end. Finally, in the preferred embodiment, the lower end of the strainer is connected with the upper end of the housing. As indicated, the downhole pump and the device, and preferably the strainer and the housing of the device, may be connected in any manner and by any process, mechanism, structure or device for fastening, attaching, mounting or otherwise connecting their adjacent ends or edges. Preferably, the connection therebetween permits the device to be conveyed or transported into, out of and within the production well with the downhole pump. Thus, in the preferred embodiment, the connection permits the housing of the device to be conveyed or transported into, out of and within the production well with the strainer of the downhole pump. More preferably, the connection permits the downhole pump and the device to be conveyed and transported together or as an integral or single unit or tool.

For example, the adjacent ends or edges of the strainer and the housing may be permanently connected together, such as by welding or gluing, or detachably connected together, such as by pins or the engagement of threaded surfaces. Further, the adjacent ends or edges of the strainer and the housing may be formed, manufactured or machined as a single or integral unit or tool. Preferably, the housing and the strainer are detachably or removably connected together to facilitate the manufacture, maintenance and use of the device. However, the specific manner, mechanism or structure by which the connection occurs is further selected such that the device, and particularly the housing, may not be easily removed from the downhole pump, and particularly the strainer, in the field in order to inhibit tampering with the device. Further, as indicated, it is desirable that the downhole pump and the device may be treated and handled, particularly in the field, as a single unit.

In a second aspect of the invention, the invention is comprised of a device for sensing and recording downhole data relating to an ambient environment in a production well in combination with a strainer for connection with a downhole pump, Preferably, the device is comprised of:

(a) a housing connected with the strainer such that the housing is conveyed with the strainer within the production well;

(b) a sensor unit contained within the housing and communicating with the ambient environment, wherein the sensor unit senses at least one condition of the ambient environment and produces output data indicative of each condition;

(c) a recording unit contained within the housing and communicating with the sensor unit, wherein the recording unit receives and stores the output data produced by the sensor unit to provide a data sample for each condition; and (d) a power source contained within the housing for powering the device.

In the second aspect, the device may be used in combination with any type, length or configuration of strainer for any type of downhole pump for a production well. Thus, as in the first aspect of the invention, the downhole pump may be a reciprocating rod pump or a rotary pump. In addition, as in the first aspect of the invention, the strainer may be perforated, slotted, corrugated, filtered or flow through.

Further, the device may be connected with the strainer, either directly or indirectly, in any manner and by any connecting, attaching, mounting or fastening mechanism, structure or method such that the device may be conveyed or transported within the production well with the strainer. Preferably, the device is connected with the strainer such that the device and the strainer may be conveyed or transported within the production well together or as an integral unit.

Further, the device, and any part or portion thereof, may be attached, fastened, mounted or otherwise connected with the any part or portion of the strainer. Preferably, the device is comprised of a housing which is connected with any part or portion of the strainer. As well, the strainer has a lower end and an upper end and the housing has a lower end and an upper end. Thus, the housing may be connected with either the upper end or the lower end of the strainer. However, preferably, the upper end of the housing is connected with the lower end of the strainer. The upper end of the strainer is adapted for connection with the downhole pump.

As indicated, the strainer and the housing of the device may be connected in any manner and by any process, mechanism, structure or device for fastening, attaching, mounting or otherwise connecting their adjacent ends or edges. As in the first aspect of the invention, the connection therebetween preferably permits the device to be conveyed or transported into, out of and within the production well with the strainer. More preferably, the connection permits the strainer and the device to be conveyed and transported together or as an integral or single unit or tool.

For example, as in the first aspect of the invention, the adjacent ends or edges of the strainer and the housing may be permanently connected together, such as by welding or gluing, or detachably connected together, such as by pins or the engagement of threaded surfaces. Further, the adjacent ends or edges of the strainer and the housing may be formed, manufactured or machined as a single or integral unit or tool. Preferably, the housing and the strainer are detachably or removably connected together to facilitate the manufacture, maintenance and use of the device. However, the specific manner, mechanism or structure by which the connection occurs is further selected such that the device, and particularly the housing, may not be easily removed from the strainer in the field in order to inhibit tampering with the device. Further, it is desirable that the strainer and the device may be treated and handled as a single unit.

Preferably, in both the first and second aspects of the invention, the lower end of the strainer is comprised of a pre-existing fitting and the housing is connected with the preexisting fitting. More preferably, the upper end of the housing is connected with the pre-existing fitting of the strainer. The pre-existing fitting of the lower end of the strainer may be of any type or configuration so long as the upper end of the housing is adapted to be compatible therewith such that the desired connection may be made between the strainer and the housing. Thus, although any type or configuration of strainer may be used, the strainer is preferably selected to include a pre-existing fitting. As a result, by adapting or designing the upper end of the housing to be compatible with the pre-existing fitting, the strainer may be retro-fit or modified to include the device.

In the preferred embodiment of the first and second aspects of the invention, the lower end of the strainer is comprised of a threaded surface, preferably an internal threaded surface or a threaded box connector. Typically, when used without the device, a strainer plug or nut having a compatible external threaded surface or threaded pin connector would be threadably engaged with the lower end of the strainer. In order to connect the device, the strainer plug or nut is removed and the internal threaded surface or threaded box connector of the strainer comprises the pre-existing fitting at the lower end. Accordingly, in the preferred embodiment, the upper end of the housing is comprised of an external threaded surface or threaded pin connector compatible with the internal threaded surface or threaded box connector of the strainer. Accordingly, the engagement of the compatible threaded surfaces provides the connection between the strainer and the housing.

The housing may be comprised of a single housing element, member or part. Alternately, the housing may be comprised of two or more elements, members or parts connected, attached, mounted or otherwise fastened together to form the housing as an integral or single unit. In this instance, the elements, members or parts may be connected, attached, mounted or otherwise fastened together by any process, mechanism or structure providing the desired connection therebetween. In addition, the elements, members or parts may be either permanently or removably or detachably connected together. In the preferred embodiment, the housing is comprised of at least two elements, members or parts removably or detachably connected together in order to facilitate the manufacture, use and maintenance of the device.

Further, the housing preferably defines a bore therein. In the preferred embodiment, the bore extends between the upper and lower end of the housing. Further, a first portion of the bore of the housing is preferably sealed from the ambient environment to provide a sealed chamber within the housing. Although the recording unit and the power source may be contained within any part or portion of the housing and in any manner compatible with their functioning and the communication of the recording unit with the sensor unit, the recording unit and the power source are preferably contained within the sealed chamber. As a result, the recording unit and the power source are protected from the ambient environment in the production well.

The sealed chamber may be sealed in any manner and by any sealing process, mechanism or structure. Preferably, the sealed chamber has an upper end and a lower end, Further, the upper end of the sealed chamber is preferably comprised of an upper sealing assembly and the lower end of the sealed chamber is preferably comprised of a lower sealing assembly such that the sealed chamber is defined therebetween.

In addition, a second portion of the bore of the housing communicates with the ambient environment to provide an environmental chamber within the housing. Although the sensor unit may be contained within any part or portion of the housing and in any manner permitting or providing for communication between the sensor unit and the ambient environment, the sensor unit is preferably exposed to the environmental chamber.

The recording unit may be comprised of any apparatus, device, tool, gauge or mechanism capable of, and compatible with, receiving and storing the output data produced by the sensor unit to provide the data sample for each condition of the ambient environment. Thus, the recording unit may be comprised of one or a combination of any mechanical, electromechanical or electronic recording apparatuses, devices, tools, gauges or mechanisms.

Preferably, the recording unit is comprised of a memory unit for storing the output data produced by the sensor unit to provide the data sample for each condition. The memory unit may be comprised of any type of memory capable of, and compatible with, storing the output data for later retrieval and analysis at the surface. For instance, the memory unit may be comprised of an electrically erasable programmable read-only memory ("EEPROM" or "flash"), an erasable programmable read-only memory ("EPROM"), a programmable read-only memory ("PROM"), a static random access memory ("SRAM"), a random access memory ("RAM"), a core memory or an analog memory or a combination thereof. Preferably, the memory unit is comprised of a non-volatile memory. In the preferred embodiment, the memory unit is comprised of a flash memory.

In addition, although the recording unit may continuously store the output data, the recording unit preferably intermittently stores the output data produced by the sensor unit to provide the data sample for each condition. The recording unit may intermittently store the output data by any method or process and may be comprised of any mechanism or device capable of storing the output data intermittently.

In the preferred embodiment, the recording unit is programmable at a predetermined frequency for intermittently storing the output data for each condition. Further, the recording unit may be further comprised of a continuously operating clock programmable at a predetermined frequency, wherein the clock is associated with the memory unit such that the output data is intermittently stored in the memory unit at the predetermined frequency. Alternately, the clock may be associated with the sensor unit such that the output data is received, and thus stored, intermittently in the memory unit.

Preferably, the predetermined frequency is variable between each condition. In addition, the predetermined frequency for each condition is preferably variable such that the frequency for storing the output data of any particular condition may vary during the use of the device.

Alternatively, the recording unit may be programmable for intermittently storing the output data for each condition upon receiving predetermined trigger output data from the sensor unit. In this case, the predetermined trigger output data is preferably variable between each condition. In addition, the predetermined trigger output data for each condition is preferably variable such that the trigger output data for any particular condition may vary during the use of the device.

The sensor unit is preferably comprised of at least one sensor for sensing a condition of the ambient environment in the production well, wherein the sensor produces the output data indicative of the condition. Any condition of the ambient environment may be sensed by one or more sensors which comprise the sensor unit. For instance, the sensed condition may be pressure, temperature, fluid density, flow rate, water cut or percentage, pH, viscosity, radioactivity, resistivity or salinity. Preferably, the sensor unit is comprised of a sensor for sensing one of a pressure, a temperature, a fluid density, a flow rate and a water content of the ambient environment in the production well. In the preferred embodiment, the sensor unit is comprised of a pressure sensor for sensing the pressure of the ambient environment in the production well and a temperature sensor for sensing the temperature of the ambient environment in the production well.

In addition, the sensor unit may be further comprised of a converter for receiving the output data produced by each sensor and for converting the output data to produce converted data for each condition, wherein the recording unit receives and stores the converted data to provide the data sample for each condition. Any converter may be used which is capable of translating or converting the output data produced by each sensor into converted data compatible with the recording unit such that the converted data may be received and stored by the recording unit. For example, the converter may be one or a combination of an analog to digital converter, an oscillator and counter or a voltage to frequency converter. In the preferred embodiment, the converter is comprised of an analog to digital converter.

Finally, any power source may be used which is capable of powering the device for the desired period of time for which the device is to be placed downhole. Preferably, the power source is comprised of an electrical energy source for energizing the device. Any electrical energy source capable of and suitable for developing electricity downhole may be used. However, the electrical energy source is preferably comprised of a battery. Any battery may be used which is capable of powering the device and which is able to be contained within the housing. For instance, the battery may be one or more of a lithium battery, a silver oxide battery, a sulfur battery or a zinc battery. In the preferred embodiment, the battery is a lithium battery, preferably size DD.

In a third aspect of the invention, the invention is comprised of a method for obtaining downhole data relating to an ambient environment in a production well utilizing a device for sensing and recording the downhole data. Preferably, the method is comprised of the steps of:

(a) connecting the sensing and recording device with a downhole pump;

(b) conveying the downhole pump and the device connected therewith into the production well to a data collection site;

(c) sensing at least one condition of the ambient environment in the production well with the device and producing output data indicative of each condition;

(d) storing the output data in the device in order to provide a data sample for each condition; and (e) retrieving the downhole pump and the device connected therewith from the production well for retrieval of the data sample from the device.

The method may be performed utilizing any device suitable for and capable of sensing and recording downhole data relating to an ambient environment in a production well. However, preferably the method is performed utilizing the device of the within invention as described herein. More preferably, the method is performed utilizing the preferred embodiment of the device of the within invention.

Further, the connecting step connects the device with a downhole pump. As described previously for the first and second aspects of the invention, the downhole pump may be any type of downhole pump for a production well, including a reciprocating rod pump or a rotary pump. Further, the connecting step may be comprised of connecting, attaching, mounting or fastening the device with the downhole pump, either directly or indirectly, in any manner and by any fastening or connecting mechanism or structure.

For instance, the connecting step may be comprised of permanently connecting the device with the downhole pump, such as by welding or gluing, or may be comprised of detachably or removably connecting the device with the downhole pump, such as by pinning or threadably engaging compatible threaded surfaces. Further, the connecting step may be comprised of forming, manufacturing or machining the device with the downhole pump to produce a single or integral unit or tool. Preferably, the connecting step is comprised of detachably or removably connecting the device with the downhole pump to facilitate the manufacture, maintenance and use of the device.

Further, the connecting step may be comprised of connecting any part or portion of the device with any part or portion of the downhole pump. Preferably, the downhole pump has an uphole end and a downhole end. Thus, connecting step may be comprised of connecting the device with either the uphole end or the downhole end of the downhole pump. However, preferably, the connecting step is comprised of connecting the device with the downhole end of the pump.

Further, the downhole end of the pump is preferably comprised of a pump intake, as described above for the first and second aspects of the invention. Thus, the connecting step is preferably comprised of connecting the device with the pump intake. In addition, in the preferred embodiment, the pump intake is comprised of a strainer, as described above, having an upper end and a lower end. Thus, the connecting step is comprised of connecting the device with the strainer, and more preferably, connecting the device with the lower end of the strainer.

Preferably, as discussed above, the lower end of the strainer may be comprised of a pre-existing fitting. Therefore, the connecting step may be comprised of connecting the device with the pre-existing fitting. More particularly, the device has an upper end and a lower end and the connecting step is comprised of connecting the upper end of the device with the pre-existing fitting. In this instance, the connecting step is preferably comprised of threadably engaging the upper end of the device with the pre-existing fitting.

The storing step may be perfomed in any manner, by any process or steps and by any device, mechanism or apparatus capable of, and suitable for, storing the output data in the device in order to provide the data sample for each condition. For instance, the storing step may be comprised of continuously storing the output data in the device. However, the storing step is preferably comprised of intermittently storing the output data to provide the data sample for each condition. Further, in the preferred embodiment, the storing step is comprised of intermittently storing the output data at a predetermined frequency for each condition. However, alternately, the storing step may be comprised of intermittently storing the output data for each condition upon receiving predetermined trigger output data.

The sensing may be performed in any manner, by any process or steps and by any device, mechanism or apparatus capable of, and suitable for, sensing at least one condition of the ambient environment in the production well and producing output data indicative of each condition. Further, the sensing step may be performed to sense at least one of any condition, characteristic or parameter of the ambient environment. For instance, the sensing step may sense one or more of a pressure, temperature, fluid density, flow rate, water cut or percentage, pH, viscosity, radioactivity, resistivity or salinity of the ambient environment. However, preferably, the sensing step is comprised of sensing at least one of a pressure, a temperature, a fluid density, a flow rate and a water content of the ambient environment in the production well. In the preferred embodiment, the sensing step is comprised of sensing the pressure of the ambient environment in the production well and sensing the temperature of the ambient environment in the production well.

In addition, the sensing step is preferably further comprised of converting the output data to produce converted data for each condition. In this instance, the storing step is comprised of storing the converted data to provide the data sample. The converting step may be performed in any manner, by any process or steps and by any device, mechanism or apparatus capable of, and suitable for, converting or translating the output data to produce converted data for each condition, wherein the converted data is capable of being stored by the subsequent storing step.

The conveying step may be performed in any manner, by any process or steps and by any device, mechanism or apparatus capable of, and suitable for, conveying or transporting the downhole pump and the device into the production well to a data collection site. Similarly, the retrieving step may be performed in any manner, by any process or steps and by any device, mechanism or apparatus capable of, and suitable for, conveying or transporting the downhole pump and the device from or out of the production well such that the data sample may be retrieved from the device. As indicated previously, preferably the device is connected with the downhole pump such that the device and the downhole pump may be conveyed or transported within, and retrieved from, the production well together or as an integral unit. Thus, in the preferred embodiment, known or conventional methods and apparatuses for running a downhole pump into or out of a production well may be used.

BRIEF DESCRIPTION OF DRAWINGS

Embodiments of the invention will now be described with reference to the accompanying drawings, in which:

FIG. 1 is a side view, partially in longitudinal cross-section, of a preferred embodiment of a sensing and recording device of the within invention in combination with a perforated strainer;

FIG. 2 is a side view, partially in longitudinal cross-section, of the sensing and recording device shown in FIG. 1 in combination with a slotted strainer;

DETAILED DESCRIPTION

Figure 3:
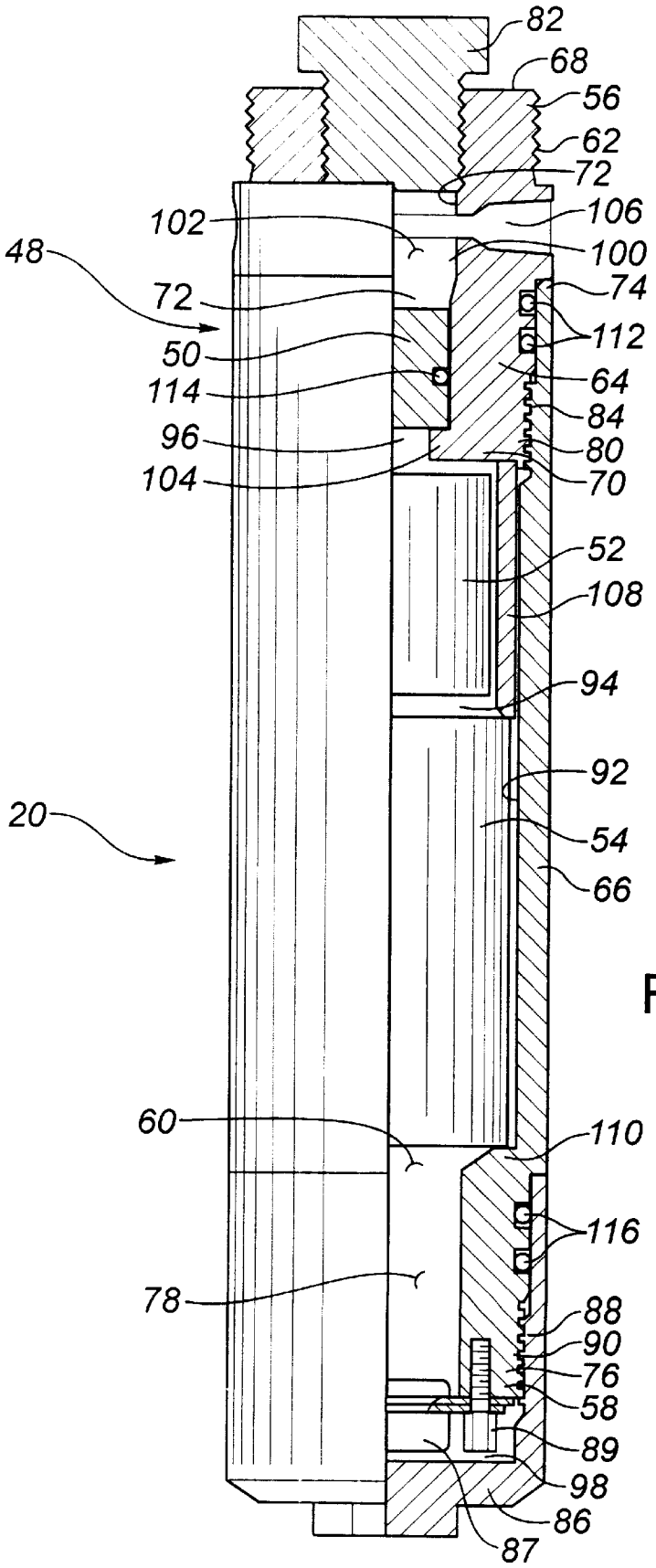
FIG. 3 is a side view, partially in longitudinal cross-section, of the sensing and recording device shown in FIG. 1 in isolation.
Figure 4:
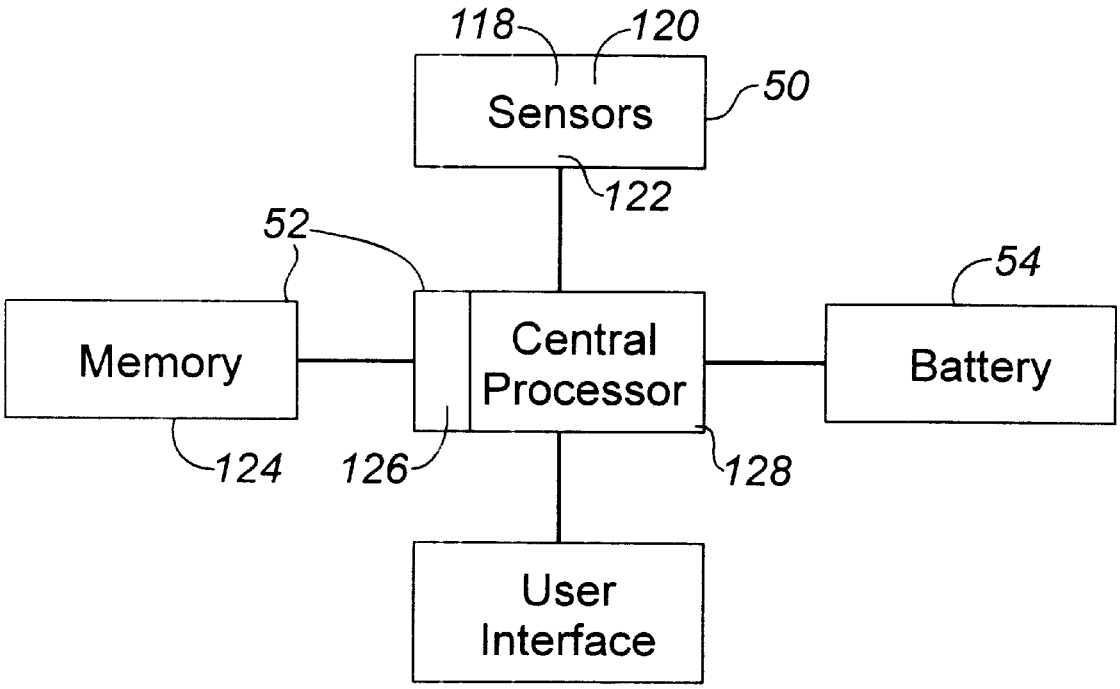
FIG. 4 is a block diagram of a preferred embodiment of the circuitry of the sensing and recording device shown in FIG. 1.

Referring to FIGS. 1–4, the present invention relates to a device (20) for sensing and recording downhole data relating to an ambient environment in a production well and to a method for obtaining downhole data relating to an ambient environment in a production well. Preferably, the method is performed utilizing the device (20). Further, the sensing and recording device (20) is preferably used in combination with a downhole pump (22), and preferably, in combination with a strainer (24) which either comprises the downhole pump (22) or is provided for connection with the downhole pump (22).

The device (20) may be used in combination with any type of downhole pump (22) for a production well. Thus, for instance, the downhole pump (22) may be a reciprocating rod pump or a rotary pump. In either event, the downhole pump (22) has an uphole end and a downhole end (26). The downhole end (26) is defined by the lowermost end of the downhole pump (22) when place within the production well or the end of the downhole pump (22) farthest from the surface. Although the device (20) may be connected with any part or portion of the downhole pump (22), it is preferably connected with the downhole end (26) as it has been found that this positioning is optimal such that the device (20) provides a relatively accurate reflection of the ambient environment or provides relatively accurate downhole data.

Preferably, the downhole end (26) of the downhole pump (22) is comprised of a pump intake (28). The pump intake (28) is the place or location at which the pump (22) typically permits the passage of fluids from the ambient environment into the downhole pump (22), for pumping to the surface of the production well. In other words, the pump intake (28) is an inlet or intake structure permitting the ambient environment in the production well to communicate with the downhole pump (22). In the preferred embodiment, the pump intake (28) is comprised of the strainer (24). The strainer (24) is provided for filtering the fluids passing from the ambient environment in the production well into the downhole pump (22).

In the preferred embodiment, the downhole pump (22) is comprised of a pump intake nut (30). The strainer (24) is connected, fastened, mounted or otherwise affixed with the pump intake nut (30) such that the strainer (24) comprises the pump intake (28) and defines the downhole end (26) of the downhole pump (22). Thus, during normal operation of the downhole pump (22), fluids pass from the ambient environment into the strainer (24) for filtering prior to pumping to the surface.

More particularly, the strainer (24) preferably has an upper end (32) and a lower end (34) and defines a bore (35) therein. The upper end (32) of the strainer (24) may be connected, fastened, mounted or otherwise affixed with the pump intake nut (30) in any manner and by any structure or mechanism permitting either a permanent or a detachable connection to be made therebetween. Preferably, a threaded connection is provided between the pump intake nut (30) and the upper end (32) of the strainer (24) such that the strainer (24) is removable or detachable from the pump intake nut (30), and thus the balance or reminder of the pump (22). In the preferred embodiment, the pump intake nut (30) is internally threaded or is comprised of a threaded box connection (36). Further, the upper end (32) of the strainer (24) is externally threaded or is comprised of a threaded pin connection (38) compatible with the threaded box connection (36). Accordingly, the threaded box connection (36) and the threaded pin connection (38) are preferably engaged or screwed together to connect the pump intake nut (30) with the strainer (24). Further, the threads may be glued to inhibit accidental unthreading or tampering with the device (20).

The strainer (24) may be of any type, length or configuration such as perforated, slotted, corrugated, filtered or flow through. For instance, referring to FIG. 1, the strainer (24) may be perforated such that the strainer (24) defines a plurality of perforations (40) or holes therein permitting the passage of fluids from the ambient environment through the perforations (40) into the bore (35) of the strainer (24) for pumping to the surface. Alternately, referring to FIG. 2, the strainer (24) may be slotted such that the strainer (24) defines a plurality of longitudinal slots (42) therein permitting the passage of fluids from the ambient environment through the slots (42) into the bore (35) of the strainer (24) for pumping to the surface.

Similarly, the lower end (34) of the strainer (24) may be connected, fastened, mounted or otherwise affixed with the device (20) in any manner and by any structure or mechanism permitting either a permanent or a detachable connection to be made therebetween. Preferably, the lower end (34) of the strainer (24) is comprised of a pre-existing fitting (44) for connection with the device (20). The strainer (24) preferably includes the pre-existing fitting (44) so that the device (20 ) may be relatively easily retro-fit to the strainer (24). The preexisting fitting (44) of the lower end (34) of the strainer (24) may be of any type or configuration so long as the device (20) is adapted to be compatible therewith such that the desired connection may be made between the strainer (24) and the device (20).

Preferably, a threaded connection is provided between the device (20) and the lower end (34) of the strainer (24) such that the device (20) is removable or detachable from the strainer (24). In the preferred embodiment, the pre-existing fitting (44) which comprises the lower end (34) of the strainer (24) is internally threaded or is comprised of a threaded box connection (46).

Typically, when used without the device (20), the strainer (24) includes a strainer plug or nut (not shown) having a compatible externally threaded surface or threaded pin connection for engagement with the threaded box connection (46) of the strainer (24). Thus, in order to connect the device (20) with the strainer (24), the strainer plug or nut is removed such that the threaded box connection (46) at the lower end (34) of the strainer (24) comprises the desired pre-existing fitting (44). In the preferred embodiment, as described in detail below, the device (20) includes a compatible threaded pin connection. Accordingly, the pre-existing fitting (44) of the strainer (24) and the device (20) are preferably threadably engaged or screwed together to connect or combine the device (20) with the strainer (24). In addition, the threads may be glued.

As indicated, the device (20) is for sensing and recording downhole data relating to an ambient environment in a production well. Preferably, the device (20) is relatively small for use downhole and is self-contained such that it need not communicate with the surface during the sensing and recording of the downhole data. The production well may be used for producing any fluids, liquids or gases, therefrom. However, preferably, the production well is a hydrocarbon producing well or a well extending to, within or through a hydrocarbon producing formation beneath the surface. The downhole data relates to the ambient environment, being the environment external to, surrounding or encompassing the device (20) when the device (20) is within the production well. The downhole data may be one or more facts, statistics, information or parameters of any kind or type whatsoever relating to the ambient environment in the production well.

The device (20) is comprised of a housing (48), a sensor unit (50), a recording unit (52) and a power source (54). The sensor unit (50) is preferably substantially contained within the housing (48) and is in communication with the ambient environment. The sensor unit (50), as discussed further below, is provided to sense at least one condition of the ambient environment and to produce output data indicative of each condition. The recording unit (52) is also preferably substantially contained within the housing (48) and is in communication with the sensor unit (50). The recording unit (52), as discussed further below, is provided to receive and to store the output data produced by the sensor unit (50) to provide a data sample for each condition. Finally, the power source (54) is also preferably substantially contained within the housing (48) and provides the power or energy for the device (20).

Each of the sensor unit (50), the recording unit (52) and the power source (54) need not be contained in the housing (48) so long as they are functionally interconnected for operation of the device (20). However, the sensor unit (50), the recording unit (52) and the power source (54) are all preferably contained, or substantially contained, within the housing (48) to provide a relatively easy to use, self-contained device (20). Further, by containing the elements within the housing (48), the sensor unit (50), the recording unit (52) and the power source (54) are all protected from or against any damage which may be incurred while being conveyed or transported within the production well. Finally, containment within the housing (48) discourages or inhibits the potential for tampering with the device (20).

The housing (48) is connected with the downhole pump (22) such that the housing (48) is conveyed or transported with the pump (22) within the production well. More particularly, the connection permits the pump (22) and the housing (48), and therefore the device (20), to be conveyed or transported within the production well together or as an integral unit.

The housing (48) may be connected with the pump (22) in any manner and by any process, mechanism, structure or device for fastening, attaching, mounting or otherwise achieving the desired connection therebetween. Preferably, the housing (48) is connected with the downhole end (26) of the pump (22). Thus, in the preferred embodiment, the housing (48) is connected with the strainer (24). Although the housing (48) may be connected with either the upper end (32) or the lower end (34) of the strainer (24), as discussed above, the housing (48) is preferably connected with the lower end (34) of the strainer (24), particularly with the preexisting fitting (44).

In the preferred embodiment, the housing (48) has an upper end (56) and a lower end (58) and defines a bore (60) therein. Further, the bore (60) preferably extends through the housing (48) substantially between the upper and lower ends (56, 58). In addition, in the preferred embodiment, the upper end (56) of the housing (48) is connected with the pre-existing fitting (44).

Accordingly, the upper end (56) of the housing (48) is adapted or specifically designed to be compatible with the pre-existing fitting (44). As a result, in the preferred embodiment, the upper end (56) of the housing (48) is externally threaded or is comprised of a threaded pin connection (62) compatible with the threaded box connection

(46) which comprises the pre-existing fitting (44) of the strainer (24). Accordingly, the threaded pin connection (62) and the pre-existing fitting (44) are preferably threadably engaged or screwed together to connect the housing (48) of the device (20) with the strainer (24). In addition, the threads may be glued.

The housing (48) may be comprised of a single housing sub, element, member or part or may be comprised of two or more subs, elements, members or parts connected, attached, mounted or otherwise fastened together, either permanently or detachably, to form the housing (48) as an integral or single unit. In the preferred embodiment, to facilitate the manufacture, use and maintenance of the device (20), the housing (48) is comprised of two subs, elements, members or parts connected, attached, mounted or otherwise removably or detachably fastened together by any process, mechanism or structure providing the desired connection therebetween.

More particularly, the housing (48) is comprised of a transducer sub (64) and a battery sub (66) threadably connected together. Although either the transducer sub (64) or the battery sub (66) may be connected with the strainer (24), in the preferred embodiment, the transducer sub (64) comprises the upper end (56) of the housing (48) and the battery sub (66) comprises the lower end (58) of the housing (48). Further, the transducer sub (64) and the battery sub (66) are preferably threadably engaged and may be glued together.

In the preferred embodiment, the transducer sub (64) has an upper end (68), a lower end (70) and a bore (72) extending therethrough. Similarly, the battery sub (66) has an upper end (74), a lower end (76) and a bore (78) extending therethrough. The upper end (68) of the transducer sub (64) comprises the upper end (56) of the housing (48) and thus provides the threaded pin connection (62) for connection to the strainer (24). The lower end (70) of the transducer sub (64) is also externally threaded or is comprised of a threaded pin connection (80) for connection with the battery sub (66).

The bore (72) of the transducer sub (64) preferably extends substantially between the upper and lower ends (68, 70) and contains the sensor unit (50) therein. The bore (72) preferably extends to the upper end (68) in order to facilitate the installment and removal of the sensor unit (50) therein. However, during operation of the pump (22), it may be desirable to inhibit the passage of fluids from the bore (35) of the strainer (24) to the bore (72) of the transducer sub (64) in order to protect the sensor unit (50) from debris within the strainer (24) and to enhance the accuracy of the sensor unit (50) in sensing the ambient environment rather than the conditions within the strainer (24). Thus, the bore (72) of the transducer sub (64) is preferably plugged, capped or otherwise blocked at, near or adjacent to the upper end (68).

The bore (72) may be plugged by any mechanism, structure or device capable of plugging the upper end (68). However, in the preferred embodiment, a plug (82) is preferably threadably engaged or screwed into the upper end (68) of the transducer sub (64) within the bore (72). As a result of the threaded engagement of the plug (82) and the bore (72), the plug (82) may be removed as desired or required for access to the bore (72). As discussed below, it is not necessary that the plug (82) sealingly engage the bore (72), although the threaded engagement will tend to provide a metal-to-metal seal therebetween.

The upper end (74) of the battery sub (66) is preferably internally threaded or is comprised of a threaded box connection (84) compatible with the threaded pin connection (80) at the lower end (70) of the transducer sub (64). Accordingly, the transducer sub (64) and the battery sub (66) are threadably engaged or screwed together to form the housing (48) of the device (20). The bore (78) of the battery sub (66) preferably extends substantially between the upper and lower ends (74, 76) such that the bore (72) of the transducer sub (64) is continuous with the bore (78) of the battery sub (66). Further, the recording unit (52) and the power source (54) are preferably contained within the bore (78) of the battery sub (66).

Finally, the bore (78) of the battery sub (66) preferably extends substantially to the lower end (76) in order to facilitate the installment and removal of the recording unit (52) and the power source (54) therein. However, during operation of the device (20), as discussed further below, it is desirable to inhibit the passage of fluids into the bore (78)of the battery sub (66) in order to protect the components of the device (20) contained therein. Thus, the bore (78) of the battery sub (66) is preferably plugged, capped or otherwise blocked at, near or adjacent to the lower end (76).

The bore (78) may be plugged or capped by any mechanism, structure or device capable of inhibiting the passage of fluids into the bore (78) through the lower end (76). However, in the preferred embodiment, a cap (86) is preferably threadably engaged or screwed onto the lower end (76) of the battery sub (66). More particularly, in the preferred embodiment, the cap (86) preferably includes an internally threaded surface or is comprised of a threaded box connection (88) compatible with a threaded pin connection (90) at the lower end (76) of the battery sub (66). As a result of the threaded engagement of the cap (86) and the lower end (76), the cap (86) may be removed as desired or required for access to the bore (78).

In addition, an electrical connector (87) is preferably connected, mounted or affixed to the lower end (76) of the battery sub (66) within the cap (86). Specifically, in the preferred embodiment, the electrical connector (87) is mounted with the lower end (76) by one or more screws (89), preferably jack screws. The electrical connector (87) is provided for communicating with the device (20) including, but not limited to, downloading information from the memory unit (124), storing information in the memory unit (124), programming the sample rates of the recording unit (52), running diagnostic checks and checking the condition of the power source (54).

Further, the recording unit (52) and the power source (54) are preferably sealed from the ambient environment. The recording unit (52) and the power source (54) may be sealed in any manner and by any sealing structure, assembly or device. In the preferred embodiment, the bore (60) of the housing (48) defines a first portion (92) of the bore (60) which is sealed from the ambient environment to provide a sealed chamber (94) within the housing (48) having an upper end (96) and a lower end (98). The recording unit (52) and the power source (54) are preferably contained within the sealed chamber (94) such that they are protected from the ambient environment. The sealed chamber (94) may be located or positioned anywhere within the bore (60) of the housing (48). However, preferably, the sealed chamber (94) is located within the battery sub (66) or defined by the bore (78) of the battery sub (66).

In addition, in the preferred embodiment, the bore (60) of the housing (48) defines a second portion (100) of the bore (60) which communicates with the ambient environment to provide an environmental chamber (102) within the housing (48). The sensor unit (50) is preferably exposed to the environmental chamber (102) such that the sensor unit (50) may sense the ambient environment. The environmental chamber (102) may be located or positioned anywhere within the bore (60) of the housing (48). However, preferably, the environmental chamber (102) is located within the transducer sub (64) or defined by the bore (72) of the transducer sub (64).

In the preferred embodiment, the sensor unit (50) is located between the environmental chamber (102) and the sealed chamber (94). Specifically, the environmental chamber (102) is defined between the plug (82) at the upper end (68) of the transducer sub (64) and the sensor unit (50) contained therein. The sensor unit (50) may be maintained in position within the bore (72) in any manner or by any mechanism, device or structure. However, preferably, the sensor unit (50) is held in position against an upwardly facing shoulder (104) defined by the bore (72).

Further, the environmental chamber (102) may communicate with the ambient environment in any manner and by any structure, mechanism or device permitting the ambient environment to access the environmental chamber (102). In the preferred embodiment, the transducer sub (64) defines one or more sensing holes (106) or conduits therethrough. Thus, the ambient environment may communicate with the environmental chamber (102) through the sensing holes (106).

Further, the sealed chamber (94) is defined between the sensor unit (50) and the cap (86) at the lower end (76) of the battery sub (66). In other words, the upper end (96) of the sealed chamber (94) is comprised of the sensor unit (50), while the lower end (98) of the sealed chamber (94) is comprised of the cap (86). The recording unit (52) and the power source (54) may be maintained in position within the bore (78) in any manner or by any mechanism, device or structure. However, preferably, the recording unit (52) is held in position by a spacer (108) abutting against the lower end (70) of the transducer sub (64). The power source (54) is held in position between a lowermost end of the spacer (108) and an upwardly facing shoulder (110) defined by the bore (78) of the battery sub (66).

As indicated, the sealed chamber (94) may be sealed in any manner and by any sealing process, mechanism or structure. However, preferably, the upper end (96) of the sealed chamber (94) is comprised of an upper sealing assembly and the lower end (98) of the sealed chamber (94) is comprised of a lower sealing assembly such that the sealed chamber (94) is defined therebetween.

In the preferred embodiment, the upper sealing assembly is comprised of one or more seals, such as one or more O-rings (112), between the lower end (70) of the transducer sub (64) and the adjacent upper end (74) of the battery sub (66) to inhibit the passage of fluids from the ambient environment into the sealed chamber (94) at the connection between the transducer sub (64) and the battery sub (66). Further, the upper sealing assembly is preferably comprised of one or more seals, such as one or more O-rings (114), between the sensor unit (50) and the adjacent bore (72) of the transducer sub (64) to inhibit the passage of fluids from the environmental chamber (102) into the sealed chamber (94).

Further, in the preferred embodiment, the lower sealing assembly is comprised of one or more seals, such as one or more O-rings (116), between the lower end (76) of the battery sub (66) and the adjacent cap (86) to inhibit the passage of fluids from the ambient environment into the sealed chamber (94) at the connection between the battery sub (66) and the cap (86).

As stated, the sensor unit (50) senses at least one condition of the ambient environment and produces output data indicative of each condition. Preferably, the sensor unit (50) is comprised of at least one sensor for sensing at least one condition of the ambient environment and producing the output data indicative of the condition. In the preferred embodiment, the sensor unit (50) is comprised of two sensors. Each sensor of the sensor unit (50) may sense any condition of the ambient environment such as pressure, temperature, fluid density, flow rate, water cut or percentage, pH, viscosity, radioactivity, resistivity or salinity. However, in the preferred embodiment, the sensor unit (50) is comprised of a pressure sensor (118) for sensing the pressure of the ambient environment in the production well and a temperature sensor (120) for sensing the temperature of the ambient environment in the production well. More particularly, each of the sensors (118, 120) is comprised of a transducer which may be piezoresistive, silicon on sapphire or any other transducer type typically used in a hostile environment.

In addition, the sensor unit (50) is preferably further comprised of, or otherwise associated with, a converter (122) for receiving the output data produced by each sensor (118, 120) and for converting the output data to produce converted data for each condition. Accordingly, the recording unit (52) preferably receives and stores the converted data to provide the data sample for each condition. In essence, the converter (122) translates or converts the output data produced by the sensors (118, 120) into converted data compatible with the recording unit (52) such that the converted data may be received and stored by the recording unit (52). In the preferred embodiment, the converter (122) is comprised of an analog to digital converter.

The recording unit (52) is preferably comprised of any electronic apparatus, device, tool, gauge or mechanism capable of, and compatible with, receiving and storing the output data produced by the sensor unit (50) to provide the data sample for each condition of the ambient environment. Thus, the sensor unit (50) is associated with the recording unit (52) by the electronic circuitry necessary for the sensor unit (50) to transmit, and the recording unit (52) to receive, the output data. However, preferably, the recording unit (52) is directly connected with the sensors (118, 120) of the sensor unit (50) via pins such that the need for wiring is eliminated, thus providing a relatively more secure connection in a high vibration environment.

In the preferred embodiment, the recording unit (52) is comprised of a memory unit (124) for storing the output data produced by the sensor unit (50) to provide the data sample for each condition. The memory unit (124) is preferably comprised of a non-volatile memory capable of, and compatible with, storing the output data for later retrieval and analysis at the surface. In the preferred embodiment, the memory unit (124) is comprised of a flash memory. More particularly, the flash memory is preferably a NAND type flash memory with a relatively large capacity in order to be able store the output data generated for a desired period. For instance, in the preferred embodiment, the memory has a capacity of about 8 megabytes and is capable of operating, and storing data, for about a 3 year period.

In addition, the recording unit (52) preferably intermittently stores the output data produced by the sensor unit (50) to provide the data sample for each condition. In the preferred embodiment, the recording unit (52) is programmable at a predetermined frequency for intermittently storing the output data for each condition. The predetermined frequency is variable between each condition. In other words, the frequency at which the output data is stored for one condition may vary from the frequency at which the output data is stored for any other condition. As a result, the frequency for intermittently storing the output data for each condition may be determined by the specific data sample requirements for each condition or the data sample desired to be obtained for each condition independently of the others.

In addition, the predetermined frequency for each condition is also preferably variable such that the predetermined frequency for storing the output data of any particular condition may vary during the use of the device. In other words, the output data for each condition may be stored at two or more predetermined frequencies or sample rates in order to collectively provide the desired data sample. For instance, the output data may be stored at a first rate for a first period of time and then stored at a second rate for a second period of time. Alternately, the output data may be concurrently stored at the first rate and the second rate such that the data sample is indicative of both predetermined frequencies.

In the preferred embodiment, the recording unit (52) is programmable at two predetermined frequencies for intermittently storing the output data indicative of each of the pressure and the temperature of the ambient environment. In other words, the output data for each of the pressure and the temperature is stored at two frequencies or sample rates to collectively provide the data sample for each condition. The first predetermined frequency stores the output data at a regular and relatively slow sample rate, such as one sample every minute or every two minutes.

The second predetermined frequency stores the output data at a faster sample rate or a burst mode designed to capture the signature or pattern of the downhole pump (22) over a relatively short interval. For instance, the recording unit (52) may store the output data at a rate of about 10 samples per second for one minute. The rate of the burst mode is preferably selected to record the pattern of the selected condition over at least one cycle of the downhole pump (22), such as one cycle of the pump jack or pump card. Typically, pump (22) signatures would be recorded once a day to provide a regular record of pump (22) activity. When the pump (22) is retrieved from the production well, the signature of the pump (22) may be analyzed and possible causes of pump failure inferred.

In the preferred embodiment, the programmable frequency is instigated by a real-time or continuously operating clock (126) which indicates that a sample is required. Thus, the recording unit (52) is preferably further comprised of the clock (126) which is programmable at the predetermined frequency or frequencies. The clock (126) may be associated with the sensor unit (50) such that the output data is received intermittently for storage in the memory unit (124).

However, the clock (126) is preferably associated with the memory unit (124) of the recording unit (52) such that the output data is received continuously but is only intermittently stored in the memory unit (124) at the predetermined frequency.

Alternatively, the recording unit (52) may be programmable for intermittently storing the output data for each condition upon receiving predetermined trigger output data from the sensor unit (50). In other words, the recording unit (52) is programmed to commence the storing of the output data upon receiving a predetermined signal from the sensor unit (50), being predetermined trigger output data. Thus, upon receiving the trigger output data, the recording unit (52) is triggered to store the output data being received. The recording unit (52) may take a single sample upon receipt of the trigger output data. Alternately, once triggered, the recording unit (52) may take a plurality of samples at a predetermined frequency for a predetermined period of time to provide the data sample or it may take a plurality of samples at a predetermined frequency until receipt of further trigger output data which triggers the recording unit (52) to cease storing the output data.

As discussed above where the output data is stored at a predetermined frequency, the predetermined trigger output data is also preferably variable between each condition. In other words, the trigger output data for one condition may vary from the trigger output data for any other condition. As well, the predetermined trigger output data for each condition is preferably variable such that the trigger output data for any particular condition may vary during the use of the device.

In the preferred embodiment, the device (20) is comprised of a central processor (128) programmable to perform the various functions of the device (20) as described herein. For instance, the central processor (128) is preferably programmable at the predetermined frequency or the predetermined trigger output data for storing the output data in the memory unit (124). Further, the central processor (128) is preferably programmable to a power down mode for minimizing power consumption by such methods as turning off power to any unused components of the device (20), slowing the speed of operation of components and switching power sources (54). The central processor (128) may be comprised of any type of processor capable of performing, coordinating or managing the desired functions of the device (20). For example, the central processor (128) may be comprised of a central processor unit ("CPU"), a microprocessor, a state machine, an analog computer or a digital signal processor ("DSP"). In the preferred embodiment, the central processor (128) is comprised of a low power microprocessor.

The central processor (128) communicates with the user of the device (20) through a user interface to perform a variety of functions including to download and upload data samples, to reprogram sample rates or predetermined frequencies or predetermined trigger output data, to erase memory, to run diagnostics, to test the sensor unit (50) and to monitor the power source (54). The user interface may be comprised of any available type of data transmission media and formats or it may be a customized method. For example, the user interface media may be direct electrical connection, isolated electrical connection, infra-red, acoustic or electromagnetic. Further, for example, the user interface format may be RS-232 (Electronic Industries Association/Telecommunications Industries Association Specification 232), RS-485 (Electronic Industries Association/Telecommunications Industries Association Specification 485), USB (Universal Serial Bus), Firewire, IRDA (Infra-Red Data Association Standard), GPIB (General Purpose Interface Bus), TCIP (Transmission Control Protocol/Internet Protocol), Ethernet or parallel port. In the preferred embodiment, the user interface is comprised of serial data over a direct electrical connection.

Finally, the power source (54) is preferably comprised of an electrical energy source capable of powering or energizing the device (20) for the desired period of time for which the device (20) is to store data downhole. Specifically, the device (20) is preferably capable of operating downhole for at least 2 years without changing or servicing the power source (54). In the preferred embodiment, the power source (54) is comprised of a battery contained within the battery sub (66) and held in place between the spacer (108) and the upwardly facing shoulder (110) in the bore (78). This particular placement of the battery in the device (20) has been found to provide a relatively large diameter for the placement of the battery therein and thus permits the use of relatively larger diameter battery for the power source (54). In the preferred embodiment, the battery is preferably a size DD 3.9V 150 C lithium battery. The device (20) preferably operates from a 3.6 V to 3.2V power source (54). Thus, the device (20) is capable of running directly off a single lithium battery, which eliminates the need for a voltage regulator and increases reliability. Further, the single lithium battery permits the device (20) to operate for about 3 years between battery changes. However, in order to operate for this period of time, the device (20) utilizes the power down mode described above. Specifically, in the preferred embodiment, the power consumption during the power down mode of the device (20) drops from 3 ma to 22 ua.

In operation, the device (20) is typically assembled and preprogrammed at a calibration facility prior to being shipped to a pump shop or facility. At the pump shop, the device (20) is connected with the downhole pump (22), in the manner previously describe to produce or provide for a single or integral unit or tool which is subsequently sent into the field for use at the production well. Specifically, in the preferred embodiment, the upper end of the device (20), being the upper end (56) of the housing (48) of the device (20), is connected with the pre-existing fitting (44) at the lower end (34) of the strainer (24). Further, the upper end (32) of the strainer (24) is connected with the pump intake nut (30). As a result, the device (20) is connected with the pump (22). Each of these connections is preferably made by threading or screwing the adjacent ends together. In addition, the engaged threaded surfaces may be glued to provide a more secure connection.

Once in the field, a service rig would convey or place the downhole pump (22) and the device (20) connected with the pump (22) into the production well using standard procedures or known or conventional methods and apparatus. More particularly, the device (20) would be conveyed to a desired depth beneath the surface to a predetermined data collection site.

Once conveyed to the data collection site, at least one condition of the ambient environment is sensed by the device (20) and output data is produced indicative of each condition. More particularly, in the preferred embodiment, the sensing of the ambient environment is comprised of sensing the pressure and the temperature of the ambient environment and producing output data indicative of each of the pressure and the temperature. Further, in the preferred embodiment, the sensing step is further comprised of converting the output data to produce converted data for each of the pressure and the temperature.

The converted data for each condition is then stored in the device (20) to provide the data sample for each of the pressure and the temperature. In the preferred embodiment, the storing step is comprised of intermittently storing the converted data to provide the data sample for each condition. The converted data is preferably intermittently stored at a predetermined frequency for each condition, however, the converted data may alternately be stored for each condition upon receiving predetermined trigger output data, as described above.

Finally, the service rig would retrieve the downhole pump (22) and the device (20) connected with the pump (22) from the data collection site in the production well using standard procedures or known or conventional methods and apparatus. Alternatively, the pump (22) and the device (20) may be conveyed to a further data collection site and the above method repeated. In any event, once the device (20) is retrieved to the surface, the data sample is retrieved or downloaded from the device (20) for analysis. Typically, the device (20) and the data sample would be retrieved during normal maintenance operations for the pump (22). Further, the device (20) would typically be returned to the calibration facility for downloading of the data sample.

What is claimed is:

1. In combination with a downhole pump, a device for sensing and recording downhole data relating to an ambient environment in a production well capable of producing fluids under a group of well operating conditions, wherein the device is comprised of:

(a) a housing connected with the downhole pump such that the housing is conveyed with the downhole pump within the production well;

(b) a sensor unit contained within the housing and communicating with the ambient environment, wherein the sensor unit senses at least one condition of the ambient environment and produces output data indicative of each condition;

(c) a recording unit contained within the housing and communicating with the sensor unit, wherein the recording unit receives and stores the output data produced by the sensor unit to provide a data sample for each condition, wherein the recording unit is comprised of a memory unit for storing the output data and wherein the recording unit is programmable at a predetermined frequency variable between each condition for intermittently storing the output data for each condition; and (d) a power source contained within the housing for powering the device.

2. The device as claimed in claim 1 wherein the downhole pump has an uphole end and a downhole end and wherein the housing is connected with the downhole end of the pump.

3. The device as claimed in claim 2 wherein the downhole end of the pump is comprised of a pump intake and wherein the housing is connected with the pump intake.

4. The device as claimed in claim 3 wherein the pump intake is comprised of a strainer and wherein the housing is connected with the strainer.

5. The device as claimed in claim 4 wherein the strainer has an upper end and a lower end and wherein the housing is connected with the lower end of the strainer.

6. The device as claimed in claim 5 wherein the lower end of the strainer is comprised of a pre-existing fitting and wherein the housing is connected with the pre-existing fitting.

7. The device as claimed in claim 6 wherein the housing has an upper end and a lower end and wherein the upper end of the housing is connected with the pre-existing fitting of the strainer.

8. The device as claimed in claim 5 wherein the housing defines a bore therein, wherein a first portion of the bore of the housing is sealed from the ambient environment to provide a sealed chamber within the housing and wherein the recording unit and the power source are contained within the sealed chamber.

9. The device as claimed in claim 8 wherein the sealed chamber has an upper end and a lower end and wherein the upper end of the sealed chamber is comprised of an upper sealing assembly and the lower end of the sealed chamber is comprised of a lower sealing assembly such that the sealed chamber is defined therebetween.

10. The device as claimed in claim 8 wherein a second portion of the bore of the housing communicates with the ambient environment to provide an environmental chamber within the housing and wherein the sensor unit is exposed to the environmental chamber.

11. The device as claimed in claim 1 wherein the recording unit is further comprised of a continuously operating clock programmable at a predetermined frequency, wherein the clock is associated with the memory unit such that the output data is intermittently stored in the memory unit at the predetermined frequency.

12. The device as claimed in claim 1 wherein the sensor unit is comprised of at least one sensor for sensing at least one condition of the ambient environment in the production well and wherein the sensor produces the output data indicative of the condition.

13. The device as claimed in claim 12 wherein the sensor unit is further comprised of a converter for receiving the output data produced by each sensor and for converting the output data to produce converted data for each condition and wherein the recording unit receives and stores the converted data to provide the data sample for each condition.

14. The device as claimed in claim 13 wherein the sensor unit is comprised of at least one sensor for sensing at least one of a pressure, a temperature, a fluid density, a flow rate and a water content of the ambient environment in the production well.

15. The device as claimed in claim 14 wherein the sensor unit is comprised of a pressure sensor for sensing the pressure of the ambient environment in the production well and a temperature sensor for sensing the temperature of the ambient environment in the production well.

16. The device as claimed in claim 13 wherein the power source is comprised of an electrical energy source for energizing the device.

17. The device as claimed in claim 16 wherein the electrical energy source is comprised of a battery.

18. The device as claimed in claim 1 wherein the recording unit is programmable at two or more predetermined frequencies for at least one condition.

19. The device as claimed in claim 18 wherein the recording unit is programmable for storing the output data at each predetermined frequency for a predetermined period of time, wherein the predetermined period of time is variable between each predetermined frequency.

20. The device as claimed in claim 19 wherein the recording unit is programmable for storing the output data for at least one condition at a first predetermined frequency for a first predetermined period of time and at a second predetermined frequency for a second predetermined period of time, wherein the second predetermined frequency is greater than the first predetermined frequency and wherein the second predetermined time is less than the first predetermined time.

21. The device as claimed in claim 20 wherein the second predetermined frequency and the second predetermined time are selected to provide output data indicative of a pattern of at least one condition over at least one cycle of the downhole pump.

22. In combination with a strainer for connection with a downhole pump, a device for sensing and recording downhole data relating to an ambient environment in a production well capable of producing fluids under a group of well operating conditions, wherein the device is comprised of:

(a) a housing connected with the strainer such that the housing is conveyed with the strainer within the production well;

(b) a sensor unit contained within the housing and communicating with the ambient environment, wherein the sensor unit senses at least one condition of the ambient environment and produces output data indicative of each condition;

(c) a recording unit contained within the housing and communicating with the sensor unit, wherein the recording unit receives and stores the output data produced by the sensor unit to provide a data sample for each condition, wherein the recording unit is comprised of a memory unit for storing the output data and wherein the recording unit is programmable at a predetermined frequency for intermittently storing the output data for each condition; and (d) a power source contained within the housing for powering the device.

23. The device as claimed in claim 22 wherein the strainer has a lower end and an upper end for connection with the downhole pump and wherein the housing is connected with the lower end of the strainer.

24. The device as claimed in claim 23 wherein the lower end of the strainer is comprised of a pre-existing fitting and wherein the housing is connected with the pre-existing fitting.

25. The device as claimed in claim 24 wherein the housing has an upper end and a lower end and wherein the upper end of the housing is connected with the pre-existing fitting of the strainer.

26. The device as claimed in claim 23 wherein the housing defines a bore therein, wherein a first portion of the bore of the housing is sealed from the ambient environment to provide a sealed chamber within the housing and wherein the recording unit and the power source are contained within the sealed chamber.

27. The device as claimed in claim 26 wherein the sealed chamber has an upper end and a lower end and wherein the upper end of the sealed chamber is comprised of an upper sealing assembly and the lower end of the sealed chamber is comprised of a lower sealing assembly such that the sealed chamber is defined therebetween.

28. The device as claimed in claim 26 wherein a second portion of the bore of the housing communicates with the ambient environment to provide an environmental chamber within the housing and wherein the sensor unit is exposed to the environmental chamber.

29. The device as claimed in claim 22 wherein the sensor unit is comprised oft at least one sensor for sensing at least one condition of the ambient environment in the production well and wherein the sensor produces the output data indicative of the condition.

30. The device as claimed in claim 29 wherein the sensor unit is further comprised of a converter for receiving the output data produced by each sensor and for converting the output data to produce converted data for each condition and wherein the recording unit receives and stores the converted data to provide the data sample for each condition.

31. The device as claimed in claim 30 wherein the sensor unit is comprised of at least one sensor for sensing at least one of a pressure, a temperature, a fluid density, a flow rate and a water content of the ambient environment in the production well.

32. The device as claimed in claim 31 wherein the sensor unit is comprised of a pressure sensor for sensing the pressure of the ambient environment in the production well and a temperature sensor for sensing the temperature of the ambient environment in the production well.

33. The device as claimed in claim 30 wherein the power source is comprised of an electrical energy source for energizing the device.

34. The device as claimed in claim 33 wherein the electrical energy source is comprised of a battery.

35. The device as claimed in claim 22 wherein the predetermined frequency is variable between each condition.

36. The device as claimed in claim 35 wherein the recording unit is programmable at two or more predetermined frequencies for at least one condition.

37. The device as claimed in claim 36 wherein the recording unit is programmable for storing the output data at each predetermined frequency for a predetermined period of time, wherein the predetermined period of time is variable between each predetermined frequency.

38. The device as claimed in claim 37 wherein the recording unit is programmable for storing the output data for at least one condition at a first predetermined frequency for a first predetermined period of time and at a second predetermined frequency for a second predetermined period of time, wherein the second predetermined frequency is greater than the first predetermined frequency and wherein the second predetermined time is less than the first predetermined time.

39. The device as claimed in claim 38 wherein the second predetermined frequency and the second predetermined time are selected to provide output data indicative of a pattern of at least one condition over at least one cycle of the downhole pump.

40. A method for obtaining downhole data relating to an ambient environment in a production well capable of producing fluids under a group of well operating conditions and utilizing a device for sensing and recording the downhole data, wherein the method is comprised of the steps of:

(a) connecting the sensing and recording device with a downhole pump;

(b) conveying the downhole pump and the device connected therewith into the production well to a data collection site;

(c) sensing at least one condition of the ambient environment in the production well with the device and producing output data indicative of each condition;

(d) storing the output data in the device in order to provide a data sample for each condition, wherein the storing step is comprised of intermittently storing the output data at a predetermined frequency for each condition to provide the data sample for each condition; and (e) retrieving the downhole pump and the device connected therewith from the production well for retrieval of the data sample from the device.

41. The method as claimed in claim 40 wherein downhole pump has an uphole end and a downhole end and wherein the connecting step is comprised of connecting the device with the downhole end of the pump.

42. The method as claimed in claim 41 wherein the downhole end of the pump is comprised of a pump intake and wherein the connecting step is comprised of connecting the device with the pump intake.

43. The method as claimed in claim 42 wherein the pump intake is comprised of a strainer and wherein the connecting step is comprised of connecting the device with the strainer.

44. The method as claimed in claim 43 wherein the strainer has an upper end and a lower end and wherein the connecting step is comprised of connecting the device with the lower end of the strainer.

45. The method as claimed in claim 44 wherein the lower end of the strainer is comprised of a pre-existing fitting and wherein the connecting step is comprised of connecting the device with the pre-existing fitting.

46. The method as claimed in claim 45 wherein the device has an upper end and a lower end and wherein the connecting step is comprised of connecting the upper end of the device with the pre-existing fitting.

47. The method as claimed in claim 40 wherein the sensing step is comprised of converting the output data to produce converted data for each condition and wherein the storing step stores the converted data to provide the data sample.

48. The method as claimed in claim 47 wherein the sensing step is further comprised of sensing at least one of a pressure, a temperature, a fluid density, a flow rate and a water content of the ambient environment in the production well.

49. The method as claimed in claim 48 wherein the sensing step is comprised of sensing the pressure of the ambient environment in the production well and sensing the temperature of the ambient environment in the production well.

50. The method as claimed in claim 40 wherein the storing step is comprised of storing the output data at a predetermined frequency variable between each condition.

51. The method as claimed in claim 50 wherein the storing step is comprised of storing the output data at two or more predetermined frequencies for at least one condition.

52. The method as claimed in claim 51 wherein the storing step is comprised of storing the output data at each predetermined frequency for a predetermined period of time, wherein the predetermined period of time is variable between each predetermined frequency.

53. The method as claimed in claim 52 wherein the storing step is comprised of storing the output data for at least one condition at a first predetermined frequency for a first predetermined period of time and at a second predetermined frequency for a second predetermined period of time, wherein the second predetermined frequency is greater than the first predetermined frequency and wherein the second predetermined time is less than the first predetermined time.

54. The method as claimed in claim 53 wherein the second predetermined frequency and the second predetermined time of the storing step are selected to provide output data indicative of a pattern of at least one condition over at least one cycle of the downhole pump.

55. In combination with a downhole pump having a downhole end comprised of a pump intake, a device for sensing and recording downhole data relating to an ambient environment in a production well capable of producing fluids under a group of well operating conditions, wherein the device is comprised of:

(a) a housing connected with the pump intake of the downhole pump such that the housing is conveyed with the downhole pump within the production well;

(b) a sensor unit contained within the housing and communicating with the ambient environment, wherein the sensor unit senses at least one condition of the ambient environment and produces output data indicative of each condition;

(c) a recording unit contained within the housing and communicating with the sensor unit, wherein the recording unit receives and stores the output data produced by the sensor unit to provide a data sample for each condition wherein the recording unit is comprised of a memory unit for storing the output data and wherein the recording unit is programmable for intermittently storing the output data for each condition upon receiving a predetermined trigger output data from the sensor unit; and (d) a power source contained within the housing for powering the device.

56. The device as claimed in claim 55 wherein the predetermined trigger output data is variable between each condition.

57. In combination with a strainer for connection with a downhole pump, a device for sensing and recording downhole data relating to an ambient environment in a production well capable of producing fluids under a group of well operating conditions, wherein the device is comprised of:

(a) a housing connected with the strainer such that the housing is conveyed with the strainer within the production well;

(b) a sensor unit contained within the housing and communicating with the ambient environment, wherein the sensor unit senses at least one condition of the ambient environment and produces output data indicative of each condition;

(c) a recording unit contained within the housing and communicating with the sensor unit, wherein the recording unit receives and stores the output data produced by the sensor unit to provide a data sample for each condition, wherein the recording unit is comprised of a memory unit for storing the output data and wherein the recording unit is programmable for intermittently storing the output data for each condition upon receiving a predetermined trigger output data from the sensor unit; and (d) a power source contained within the housing for powering the device.

58. The device as claimed in claim 57 wherein the predetermined trigger output data is variable between each condition.

59. A method for obtaining downhole data relating to an ambient environment in a production well capable of producing fluids under a group of well operating conditions and utilizing a device for sensing and recording the downhole data, wherein the method is comprised of the steps of:

(a) connecting the sensing and recording device with a downhole pump;

(b) conveying the downhole pump and the device connected therewith into the production well to a data collection site;

(c) sensing at least one condition of the ambient environment in the production well with the device and producing output data indicative of each condition;

(d) storing the output data in the device in order to provide a data sample for each condition, wherein the storing step is comprised of intermittently storing the output data for each condition upon receiving predetermined trigger output data to provide the data sample for each condition; and (e) retrieving the downhole pump and the device connected therewith from the production well for retrieval of the data sample from the device.

60. The method as claimed in claim 59 wherein the storing step is comprised of storing the output data upon receiving predetermined trigger output data variable between each condition.

61. The method as claimed in claim 60 wherein the downhole pump has a downhole end comprised of a pump intake and wherein the connecting step is comprised of connecting the device with the pump intake.

62. The method as claimed in claim 61 wherein the pump intake is comprised of a strainer having a lower end and wherein the connecting step is comprised of connecting the device with the lower end of the strainer.

63. The method as claimed in claim 62 wherein the lower end of the strainer is comprised of a pre-existing fitting and wherein the connecting step is comprised of connecting an upper end of the device with the pre-existing fitting.

* * * * *